US005841045A

United States Patent [19]

McCandlish et al.

[11] Patent Number: 5,841,045

[45] Date of Patent: Nov. 24, 1998

[54] CEMENTED CARBIDE ARTICLES AND MASTER ALLOY COMPOSITION

[75] Inventors: Larry E. McCandlish; Rajendra K. Sadangi, both of Highland Park, N.J.

[73] Assignees: Nanodyne Incorporated, New Brunswick; Rutgers University, Piscataway, both of N.J.

[21] Appl. No.: 518,498

[22] Filed: Aug. 23, 1995

[51] Int. Cl.[6] ..... C22C 29/02

[52] U.S. Cl. ..... 75/236; 75/242; 75/252

[58] Field of Search ..... 75/236, 239, 240–242, 75/246, 252, 241

[56] References Cited

U.S. PATENT DOCUMENTS

| | | | |
|---|---|---|---|
| 3,215,510 | 11/1965 | Kelly et al. . | |
| 3,454,375 | 7/1969 | Montgomery . | |
| 3,512,962 | 5/1970 | Holtz, Jr. . | |
| 3,515,540 | 6/1970 | Meadows | 75/5 |
| 3,723,359 | 3/1973 | Borg et al. | 252/513 |
| 4,101,318 | 7/1978 | Rudy | 75/240 |
| 4,182,627 | 1/1980 | Hardwick et al. | 75/5 |
| 4,299,629 | 11/1981 | Haack | 75/252 |
| 4,820,482 | 4/1989 | Fischer et al. . | |
| 4,851,041 | 7/1989 | Polizzotti et al. | 75/240 |
| 5,023,145 | 6/1991 | Lomax et al. | 428/614 |
| 5,069,872 | 12/1991 | Penoza | 420/436 |
| 5,230,729 | 7/1993 | McCandlish et al. | 75/351 |
| 5,288,676 | 2/1994 | Shimada et al. | 501/93 |
| 5,338,330 | 8/1994 | Polizzotti et al. | 75/228 |
| 5,352,269 | 10/1994 | McCandlish et al. | 75/351 |
| 5,372,797 | 12/1994 | Dunmead et al. | 423/430 |
| 5,580,666 | 12/1996 | Dubensky | 428/552 |

OTHER PUBLICATIONS

Storms, E. K., The Refractory Carbides, vol. II, Chapter IV, *The Vanadium–Vanadium Carbide System*, Academic Press (1967), pp. 47–60.

Storms, E. K., The Refractory Carbides, vol. II, Chapter VII, *The Chromium–Chromium Carbide System*, Academic Press (1967), pp. 102–121.

YaKasolapoua, T., Carbides: Properties, Production and Applications, Plenum Press (1971), pp. 123–72.

Yakasolapoua, T., Carbides: Properties, Production and Applications, Plenum Press (1971), pp. 147–153.

Quensanga, Alex, *High Temperature Thermodynamic Study of the Reduction of* $Cr_2O_3$ by Graphite, Z. Metallkde, pp. 70–72.

*Primary Examiner*—Ngoclan Mai

*Attorney, Agent, or Firm*—Wood, Herron & Evans, L.L.P.

[57] ABSTRACT

A low melting point alloy is used to sinter metal carbide particles. The alloy is a eutectic-like alloy formed from a binding metal such as iron, cobalt or nickel, in combination with vanadium and chromium. The alloy is preferably formed by forming two separate alloys and blending these together. The first alloy is formed by spray drying together a solution of a binding metal salt such as a cobalt salt with a solution of a chromium salt. The formed particles are then carburized to form a cobalt-chromium-carbon alloy. A separate vanadium alloy is formed in the same manner. The two are combined to establish the amount of chromium and vanadium desired, and this, in turn, is used to sinter metal carbide parts. This permits sintering of the metal carbide parts at temperatures less than 1250° C. and in turn significantly inhibits grain grown without a significant decrease in toughness. It is particularly adapted to form carbide products wherein the carbide grain size is as low as 120 nanometers.

27 Claims, 2 Drawing Sheets

CEMENTED CARBIDE ARTICLES AND MASTER ALLOY COMPOSITION

GOVERNMENT RIGHTS

Work leading to this invention was funded in part through the Office of Naval Research Grant #N00014-91-J-1828. Accordingly, the United States government may own certain rights in this invention.

BACKGROUND OF THE INVENTION

Cemented carbide articles such as cutting tools, mining tools, and wear parts are routinely manufactured from carbide powders and metal powders by the powder metallurgy techniques of liquid phase sintering or hot pressing. Cemented carbides are made by "cementing" hard tungsten carbide (WC) grains in a softer fully-dense metal matrix such as cobalt (Co) or nickel (Ni).

The requisite composite powder can be made in two ways. Traditionally, WC powder is physically mixed with Co powder in a ball or attritor mill to form composite powder in which WC particles are coated with Co metal. A newer way is to use spray conversion processing, in which composite powder particles are produced directly by chemical means. In this case, a precursor salt in which W and Co have been mixed at the atomic level, is reduced and carbonized to form the composite powder. This method produces powder particles in which many WC grains are imbedded in a cobalt matrix. Each individual powder particle with a diameter of 50 micrometers contains WC grains a thousand times smaller.

The next step in making a cemented carbide article is to form a green part. This is accomplished by pressing or extruding WC-Co powder. The pressed or extruded part is soft and full of porosity. Sometimes further shaping is needed, which can be conveniently done at this stage by machining. Once the desired shape is achieved, the green part is liquid phase sintered to produce a fully dense part. Alternatively, a fully-dense part is sometimes produced directly by hot pressing the powder. In a final manufacturing step, the part is finished to required tolerances by diamond grinding.

Cemented carbides enjoy wide applicability because the process described above allows one to control the hardness and strength of a tool or part. High hardness is needed to achieve high wear resistance. High strength is needed if the part is to be subjected to high stresses without breaking. Generally, cemented carbide grades with low binder levels possess high hardness, but have lower strength than higher binder grades. High binder levels produce stronger parts with lower hardness. Hardness and strength are also related to carbide grain size, the contiguity of the carbide grains and the binder distribution. At a given binder level, smaller grained carbide has a higher hardness. Trade-off tactics are often adopted to tailor properties to a particular application. Thus, the performance of a tool or part may be optimized by controlling amount, size and distribution of both binder and WC.

The average WC grain size in a sintered article will not, generally, be smaller than the average WC grain size in the powder from which the article was made. Usually, however, it is larger because of grain growth that takes place, primarily, during liquid phase sintering of the powder compact or extrudate. For example, one can start with 50 nanometer WC grains in a green part and end up with WC grains larger than 1 micrometer.

A major technical challenge in the art of sintering is to limit such grain growth so that finer microstructures can be attained. Thus, it is typical to add a grain growth inhibitor to WC-Co powder before it is compacted or extruded. The two most commonly used grain growth inhibitors are vanadium carbide (VC) and chromium carbide ($Cr_3C_2$). However, the use of these additives presents some problems. First, both are particularly oxygen sensitive, and when combined with WC and binder metal in a mill, both tend to take up oxygen, forming surface oxides. Later, during the liquid phase sintering step, these oxides react with carbon in the mixture to form carbon monoxide (CO) gas. If extra carbon has not been added to the powder to allow for this consumption of carbon, the oxides react with WC and Co to form brittle η-phases, which ruin the article. If too much carbon has been added, so-called carbon porosity results, again ruining the article. Even if just the right amount of carbon has been added, the evolution of CO gas itself can lead to unacceptable levels of porosity. High oxygen levels in powder compacts or extrudates lead to major problems during their sintering.

Of these two grain growth inhibitors, VC is most effective at limiting growth of WC grains. However, VC itself is harder and more brittle than WC. If more than about 0.5 weight per cent is added to the powder, the sintered article becomes too brittle for many applications. Higher levels of $Cr_3C_2$ are tolerable. It does not alter strength nearly as drastically as VC, but also it is not nearly as effective at inhibiting WC grain growth. Furthermore, higher levels of $Cr_3C_2$ mean higher levels of oxygen and consequently difficulties in sintering. The best compromise seems to be the use of a suitably small amount of $Cr_3C_2$ in combination with a somewhat lesser amount of VC. The addition of $Cr_3C_2$ to the powder has the added benefit of increasing the corrosion resistance of the tool or part.

During liquid phase sintering the binder metal melts. In the case of WC-Co materials the sintering temperature is chosen in the range 1350°–1500° C. The liquid metal wets the WC grains and capillary forces cause the grains to reposition, packing closer together as porosity is reduced. Any remaining porosity can be eliminated by raising the sintering temperature, thereby increasing the amount of liquid that is present, which permits further rearrangement of WC grains. Alternatively, the temperature can be held constant and the sintering time increased, allowing larger WC grains to grow at the expense of smaller WC grains. In this way, the remaining WC grains can rearrange so that their center of masses are closer together. The latter grain growth process is called Oswald ripening. It is an activated process, which means that the rate of grain growth is higher at higher temperatures. Thus if one wants to maintain small grains, it is clear that the lowest possible sintering temperature is to be favored. Generally, compositions with a low binder level require higher sintering temperature to produce enough liquid to totally eliminate porosity. Low binder level compositions are the most difficult compositions to sinter to full density. In such cases, it is often necessary to liquid phase sinter the part at increased pressure (sinter-HIP) or to post-HIP the sintered part to completely close all porosity.

The carbide industry, in the past, has balanced and offset the problems and advantages associated with using grain growth inhibitors, higher temperatures, higher pressures and so on, attempting to maximize tool or part performance by adjusting composition and WC grain size while working within the natural constraints inherent in WC-Co material system.

SUMMARY OF THE INVENTION

The present invention is premised upon the realization that a low-melting-point binding alloy, referred to as a "master alloy" or a "sintering aid", can be formed from one or more binder metals, such as iron, cobalt or nickel, in combination with a minor portion of one or more grain growth inhibitor metals (so called because carbides of these metals are commonly used as grain growth inhibitors), such as vanadium, chromium, tantalum or niobium, and carbon. This binding alloy can be formed as a single constituent incorporating the binding metal(s), inhibitor metal(s), and carbon or, alternatively, as several constituents, each one of which is a different low-melting-alloy. An example of the former type of alloy is a powder consisting of particles comprised of cobalt, chromium, vanadium and carbon. An example of the latter type of alloy is a powder mixture of particles comprising cobalt, chromium and carbon; and particles comprising cobalt, vanadium and carbon. The former has the advantage that only one powder need be produced and handled. The latter has the advantage of increased manufacturing flexibility in that various proportions of the separate alloys can be milled together to change the composition of the sintering aid. In any case the formed alloys melt at a temperature sufficiently low to permit excellent sintering at temperatures significantly lower than 1350° C., and as low as 1200° C. −150° to 200° C. below normal sintering temperatures used to manufacture WC-Co tools and parts.

In particular, the present invention incorporates a particle forming method in combination with a carbonization process to form X-Y-C alloy powders for use as grain growth inhibitors and/or sintering aids, wherein X is one or more binder metal(s) chosen from the group Co, Ni or Fe, and Y is one or more inhibitor metal(s) chosen from the group Cr, V, Ta or Nb. Low-melting Co-Cr-C, Co-V-C, and Co-Cr-V-C alloys, for example, are prepared by spray drying homogeneous mixtures of a metal salt such as cobalt nitrate, a chromium salt such as $(CH_3CO_2)_7Cr_3(OH)_2$ and/or a vanadium salt such as ammonium vanadate. The spray dried salt mixture is carbonized in a dilute stream of methane, ethane or ethylene and hydrogen to remove oxygen and add carbon to the system when forming the alloy. Alternatively, the alloys may be formed by milling one or more binder metal(s) with one or more carbides of grain growth inhibitor metal(s). These compositions melt at a temperature significantly below 1320° C.

In turn, these alloys permit the low temperature, liquid phase sintering of ceramic powders, cermet powders and mixtures thereof to density of 95% thereby preferably 98% to 99%. Preferably the ceramic powder will be tungsten carbide, molybdenum carbide, chromium carbide, tantalum carbide, niobium carbide, vanadium carbide, titanium carbide or mixtures thereof. This is especially useful in sintering powders that contain nano-size WC grains. The cermets would be combinations of ceramic powders with iron, cobalt or nickel. Generally, these alloys permit the low temperature sintering of any ceramic-metal (cermet) composite powders, ceramic powders or mixtures of ceramic powders and cermet powders.

It is important, for reasons cited above, to limit the amount of grain growth inhibitor in a sintered tool or wear part. If low-melting binder alloy powder(s) are used to sinter pure WC powder, the resulting article will, for most useful amounts of binder, contain too much inhibitor. The process of the present invention circumvents this problem, for example, by using WC-Co composite powder in combination with low-melting Co-Cr-C and Co-V-C binder alloys to form green parts. The cobalt solid solution in the WC-Co composite powder particles melts at about 1320° C., while low-melting binder alloy particles melt below about 1200° C. When the alloy particles melt, some of the WC-Co particles dissolve thereby increasing the volume of liquid phase and further lowering the melting temperature of the liquid phase. In any case, the amount of Co in the WC-Co particles is adjusted to dilute the amount of chromium carbide and vanadium carbide in the final product to an acceptable low level. This procedure succeeds because the amounts of low-melting binder alloy(s) needed to produce useful compositions for tools and parts, provide enough liquid at low temperature for complete densification to take place.

In a preferred embodiment, the present invention can be used to produce ceramic particles bonded by a cobalt-chromium-vanadium-carbon alloy having a size less than 500 nanometers and preferably tungsten carbide with 120 nanometer mean tungsten carbide grain size having low A-type porosity, excellent density, high hardness and high magnetic coercivity.

The objects and advantages of the present invention will be further appreciated in light of the following detailed descriptions and drawings in which:

DETAILED DESCRIPTION

Figure 1:
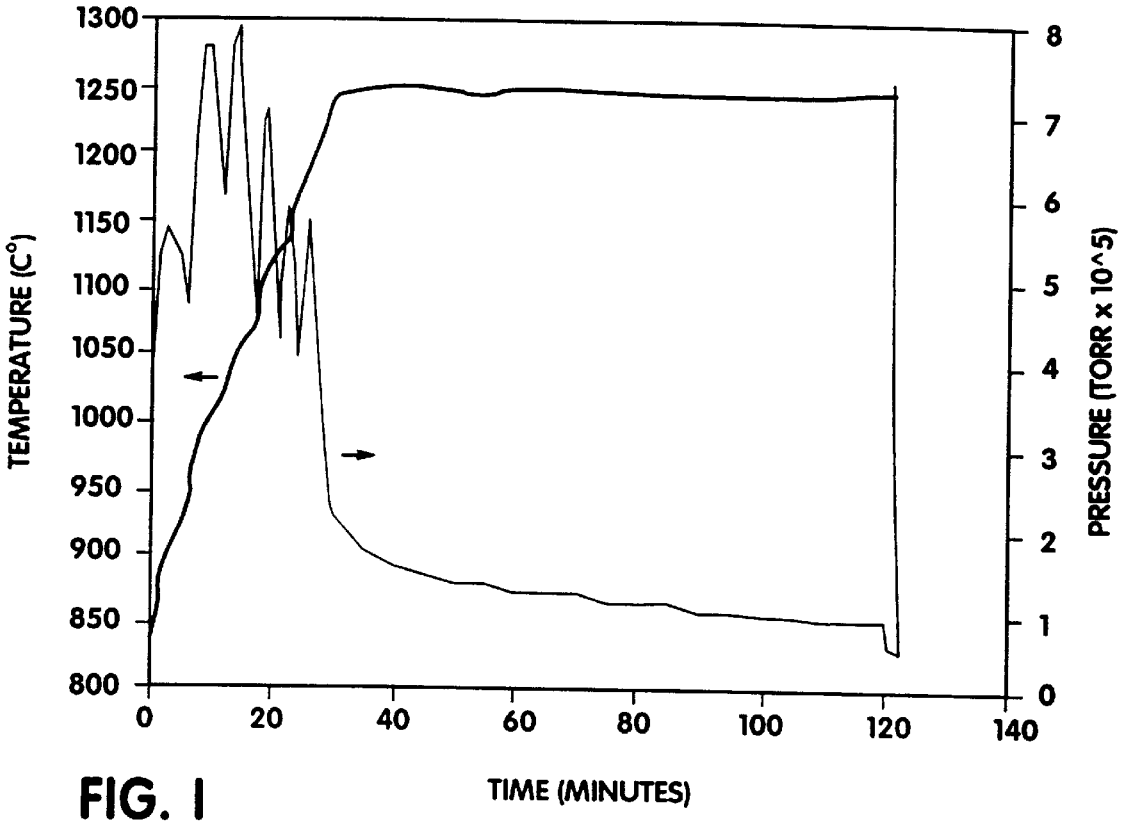
FIG. 1 is a graphic depiction of the sintering temperature/pressure used in Example G.

According to the present invention, abrasive carbide containing particles will be sintered together, singly or in combination, using a binding alloy comprising binding metal(s), such as cobalt, nickel and/or iron, in combination with a lesser amount of grain growth inhibitor metal(s), such as vanadium, chromium, tantalum and/or niobium, in combination with carbon.

The abrasive carbide can be any typical abrasive metal carbide, alone or in combination, such as tungsten carbide, molybdenum carbide, chromium carbide, tantalum carbide, titanium carbide, niobium carbide or vanadium carbide. These can be comprised of individual particles of the carbide, or are generally comprised of composite particles which are carbide grains embedded in a matrix of binding metal, particularly cobalt, nickel or iron. While the abrasive carbide content can be adjusted to from 50% to 97%, the preferred amount will be from about 70% to about 95%. All percents used herein are by weight, unless otherwise specified.

These particles can be purchased from various sources. A preferred method of manufacturing, particularly small submicron grains is disclosed, for example, in Polizotti U.S. Pat. No. 5,338,330 entitled "Multiphase Composite Particle Containing A Distribution of Nonmetallic Compound Particles," McCandlish U.S. Pat. No. 5,230,729 entitled "Carbothermic Reaction Process for Making Nanophase WC-Co Powders" and McCandlish U.S. Pat. No. 5,352,269 entitled "Spray Conversion Process for the Production of Nanophase Composite Powders."

Any or any combination of cobalt, nickel and iron can be employed as the binding metal in the present invention. However, cobalt is preferred because of its ability to wet the carbide-containing particles. Preferably, the total amount of binding alloy will be 5% to 30%. The total amount of binder is the sum of the amount added as pure binder powder, the amount added as part of composite carbide/binder powder and the amount added as part of the low-melting alloy(s).

The low-melting binding alloy can be formed in one of two manners. In the simplest method, a binding metal can be mixed and/or milled with the desired amount of grain growth inhibitor metal (see Table) in the form of a metal carbide, e.g., vanadium carbide and/or chromium carbide. The milled powder can then be melted at a temperature of 1200° C. to 1300° C., after treatment to remove surface oxide. Surface oxide removal can be accomplished by heating the powder to between 900° C. and 1000° C. in a flowing stream of hydrogen gas that contains 0.5 to 5 vol % of a carbonizing gas such as methane or ethane for a time effective to remove the oxide. The low-melting binding alloy may undergo either eutectic-type melting, as is the case for chromium, or peritectic-type melting, as is the case for vanadium.

The amount by weight of binding metal, carbon, vanadium chromium, tantalum or niobium can be adjusted to achieve a melting temperature of less than 1300° C. Specifically the amount of chromium vanadium, tantalum and niobium are adjusted to achieve this low melting point. Generally the alloy will contain less than 60% iron.

The alloy will have at least about 3% of vanadium, chromium, tantalum or niobium. The amount of chromium will be from 0–25%. The amount of vanadium, tantalum or niobium will be from 0–20%. Preferably the vanadium content is minimized to improve performance. Generally the alloy will include 5–25% chromium, tantalum or niobium and 3 to 20% vanadium.

The carbon present will be about equal to the amount present if all of the vanadium, chromium, niobium or tantalum were present as VC, $Cr_3C_2$, NbC or TaC, respectfully. Thus the carbon content is largely dependent on the combined amount of vanadium, chromium and niobium and tantalum.

The following table shows the approximate liquidus temperature for alloys having cobalt carbon and either vanadium or chromium. Chromium and vanadium can also be used in combination.

| Co (%) | $Cr_3C_2$ (%) | Approximate Liquidus (°C.) |
|---|---|---|
| 95 | 5 | 1300 |
| 90 | 10 | 1260 |
| 80 | 20 | 1230 |
| Co (%) | VC (%) | Approximate Liquidus (°C.) |
| 95 | 5 | 1260 |
| 90 | 10 | 1260 |
| 80 | 20 | 1260 |

An alloy formed from 80% Co and 20% NbC should have a temperature of about 1237° C. An alloy of 80% Co and 20% TaC should have a liquidus temperature of about 1280° C.

The low-melting binding alloy can also be made by dissolving a binding-metal-containing composition and a melt-suppressant-metal-containing composition in a solvent, again in the desired weight percentages. Suitable binding material compositions would include cobalt, nickel, and iron nitrates, acetates, citrates, oxides, carbonates, hydroxides, oxalates and various amine complexes. Preferably, these will be compositions containing only the binding metal and elements from the group carbon, nitrogen, oxygen and hydrogen. To form the chromium containing or vanadium containing alloy, a composition containing the binding metal and a chromium containing composition or a vanadium containing composition are dissolved in an appropriate solvent. Suitable chromium compositions can include acetates, carbonates, formates, citrates, hydroxides, nitrates, oxides, formates, and oxalates. Suitable vanadium compositions include vanadates and oxides. It is important, of course, to select a binding metal composition in combination with a chromium containing composition or vanadium containing composition, both of which are soluble in the same solvent. The preferred solvent is water, although organic solvents can be employed, depending on the solubility of the various compositions.

The solution is then spray dried to form homogeneous discrete powder particles. This powder can, in turn, be carbonized by heating in a flowing stream of hydrocarbon/hydrogen gas mixture, as described hereinafter for a time effective to cause the reaction of the powder to form the low-melting binding alloy. Generally, the temperature will be about 800° C. to about 1100° C., the time 1 hour to about 24 hours. Various types of furnaces can be used, such as a fluidized bed reactor, a rotating bed reactor, a stationary bed reactor such as a tubular reactor or a belt furnace, or the like. The carbonizing gas should be introduced at a flow rate sufficient to purge reaction products from the furnace. The optimum flow rate will depend on such factors as type and size of furnace and size of powder load. Suitable carbonizing gases include the lower molecular weight hydrocarbons such as methane, ethane, ethylene and acetylene. The formation of the low melting alloy is further described in the Examples below.

In the practice of this invention, the ceramic, cermet or mixture of ceramic and cermet is combined with binder powder and low-melting alloy powder(s) in proportions to give the desired final composition. The mixture is milled until a powder of about 1 micron-size particles is achieved. Next, the powder is formed into a green part and finally sintered to make a dense desired article, i.e., 95 to 99% theoretically.

The proportions of low-melting alloy powder(s), binder powder(s), and/or composite binder-containing powder(s) are adjusted so that after sintering, the grain growth inhibitor concentrations are sufficiently diluted from what they were in the low-melting alloy powder(s), so as not to excessively impair mechanical properties of the final product. It is preferable, again for example, to have a combination of vanadium and at least one other grain growth inhibitor selected from the group consisting of chromium, tantalum and/or niobium in combination with carbon to maximize grain growth inhibition and, at the same time, minimize the decrease in toughness brought on by the use of vanadium. Accordingly, in the final sintered product it is generally preferred to have an amount of chromium, tantalum or niobium equivalent to 0.1%–3% $Cr_3C_2$ NbC or TaC in combination with an amount of vanadium equivalent to 0.1%–0.5% VC in the final sintered article.

In these sintered compositions a preferred range is carbide particles (ceramic), 5–30% binder metal, 0 to 10% V, Cr, Ta or Nb and carbon. For a WC-Co combination a preferred ratio is WC, 5–30% Co, 0–10% Cr, 0–10% V and C wherein at least 0.3% of V and/or Cr are present.

Preferably the ceramic particles will have a particle size prior to sintering of less than 1.0 micron and preferably less than 0.5 micron and most preferably less than 120 nanometers. In one embodiment when a combination of ceramic and cermet particles are combined, the grain size of the ceramic particles can be 1 to 20 microns and the cermet particles has a ceramic phase mean grain size of less than 1 micron. Although not essential, the preferred method of sintering is liquid phase sintering. The sintering temperature will be less than 1,300° C. preferably less than 1,280° C., i.e., the liquid forming temperature of the master alloy.

The practice of this invention is further described in the following Examples.

EXAMPLE A

Co-Cr-C Low Melting Point Chromium Alloy Grain Growth Inhibitor for Sintering WC-Co Compositions A precursor solution for the chromium alloy was prepared by dissolving 111.2 g of cobalt acetate tetrahydrate, $Co(CH_3CO_2)_3.4H_2O$, and 19.2 g of chromium acetate hydroxide, $(CH_3CO_2)_7Cr_3(OH)_2$, in 750 ml deionized water. These proportions of salts are appropriate for producing a $Cr_3C_2$-82Co alloy upon reduction of Co and carburization of Cr.

A precursor powder for the master alloy was prepared by spray drying the precursor solution in a Yamato laboratory-scale spray dryer. A Spray Systems bi-fluid nozzle (2850 SS Nozzle and 64-5 SS Cap) was used to atomize the solution. Atomizing air pressure was 2 Kgf/mm$^2$ and the solution flow rate was 20 cm$^3$/min. The drying-air flow was 0.6 standard m$^3$/min. The inlet air temperature was set at 325° C. and the outlet air temperature was maintained between 90° C. and 100° C. The soluble precursor powder, so obtained, was a light violet color.

Three hundred milligrams of precursor powder was placed in a platinum boat for reaction with a gas mixture of hydrogen and ethylene in a controlled atmosphere thermogravimetric analyzer (TGA). The reactor was first evacuated to a pressure of 3.6 Torr and then back-filled with argon. The argon atmosphere in the reactor was then displaced by a flowing (180 cm$^3$/min) mixture of one percent ethylene in hydrogen. The temperature of the reactor was ramped to 900° C. in 60 minutes, held at 900° C. for 37 minutes and cooled to room temperature in 60 minutes. The change in sample weight during the reaction cycle was recorded. X-ray diffraction analysis showed a small diffraction peak for Co metal, but was otherwise featureless. The master alloy powder was placed in an alumina crucible and melted at 1200° C. in vacuum.

A larger batch of master alloy was prepared in an alumina boat in a horizontal tube furnace by reductive carburization of 12 g of master alloy precursor powder. Again, one percent ethylene in hydrogen was used as a carbon source gas. The reactor was evacuated and back filled with argon before starting the temperature ramp (15° C./min). The reactor temperature was held at 900° C. for 8 hours. The sample was cooled in a hydrogen atmosphere to 150° C. and then in an argon purge to 50° C.

EXAMPLE B

A double batch of chromium alloy powder was made in tandem boats at 900° C. according to the preparation reported in Example A. 12.54 g of precursor powder was placed in the upstream boat and 15.81 g of precursor powder was placed in the down-stream boat.

EXAMPLE C

A new batch of chromium alloy powder was produced from 13.441 g of precursor powder. The sample was heated to 400° C. at 3° C./min in hydrogen flowing at 180 cm$^3$/min. At 400° C. the heating rate was increased to 15° C./min and 3.8 cm$^3$/min of $C_2H_2$ was added to the flowing hydrogen. The sample was heated to 900° C. and held there for 8 hours. The sample was cooled to room temperature under hydrogen. 4.1818 g of Master Alloy were produced. We recovered 3.8541 g after discarding the end of the cake which was near the carbon deposition zone. This modified preparation developed a finer porosity inside the Master Alloy cake than was previously obtained.

The low melting vanadium containing alloy can be formed by a method similar to that used in the formation of the low melting chromium containing alloy described above. Generally, it is preferable to have somewhat less vanadium. Generally, the vanadium content will be less than 20 percent down to about 5 percent, relative to the amount of cobalt present. As with the chromium alloy, a precursor powder is formed preferably by spray drying a solution containing the desired concentration of vanadium composition and a binding metal composition. Suitable vanadium compositions include ammonium vanadate and vanadium oxide. The formed spray dried precursor powder is heated in a reactor with a flowing stream of carbon-containing gas at a temperature of about 800° C. to about 1100° C. for a period of time sufficient to form the vanadium alloy. This is further described in the following example.

EXAMPLE D

Co-V-C Low Melting Point Vanadium Alloy Grain Growth Inhibitor for Sintering WC-Co Compositions 4.7948 g of spray dried $Co(NO_3)_2/NH_4VO_3$ (12.06% V by ICP) was converted in a tube furnace at 1100° C. for 8 hours in $H_2$-1% $C_2H_4$ flowing at 180 cc/min. The procedure yielded 2.7264 g of Co-V-C master alloy. The x-ray diffraction pattern showed a minor amount of VC, Co metal, and major unidentifiable peaks.

It is interesting to note that when the low melting alloy containing cobalt, chromium and carbon is formed by reaction of a precursor powder with a carbonizing gas, the product, when tested by x-ray diffraction, does not show peaks that are characteristic of chromium carbide. Likewise, when the low melting alloy containing cobalt, vanadium and carbon is formed by reaction of a precursor powder with a carbonizing gas, the x-ray diffraction pattern of the product shows only minor peaks attributable to vanadium carbide and major peaks due to unidentified phase(s). In other words, under reaction conditions such that one might expect the formation of $Cr_3C_2$ or VC, one finds that these carbides are not formed. Rather, the presence of Co inhibits their formation, and an unexpected product is obtained. Nevertheless, as described above, low melting chromium and vanadium alloys can be made by milling together appropriate amounts of chromium carbide and/or vanadium carbide and cobalt. Low melting alloys, formed either by chemical reaction or milling, function equivalently in the cementing of abrasive carbides in the practice of this invention.

EXAMPLE E

Preparation of Co-$Cr_3C_2$ and Co-VC Master Alloy Powders by Mechanical Mixing 0.6586 g of $Cr_3C_2$ powder was mixed with 3,0004 g of Co powder to produce a mixed powder of the desired composition. The mixed powder was annealed in a tube furnace in hydrogen at 900° C. for 8 hours.

0.5089 g of VC powder was mixed with 3.001 g of Co powder to produce a mixed powder of the desired composition. The mixed powder was annealed in a tube furnace in hydrogen at 900° C. for 8 hours.

The chromium and vanadium alloys of the present invention can be used either alone or in combination to form cemented carbide tools or wear parts.

The use of these alloys in the formation of cemented carbide is further illustrated in the following examples.

EXAMPLE F

Preparation of WC-8Co-0.8$Cr_3C_2$-0.4VC Powder from WC-2.1Co+Co-Cr-C Master Alloy Powder+ Co-V-C Master Alloy Powder 1.4372 gm of Co-Cr-C master alloy powder, prepared as in Example A, 0.8922 gm of Co-V-C master alloy powder, prepared as in Example D, and 30.0007 gm of WC-2.1 Co powder were mixed by shaking in a capped test tube. The master alloy powders were added along with the WC-2.1Co powder, in small amounts, until the master alloy powders were consumed. Increasing amounts of WC-2.1Co powder were added to the mixed powders until all of the WC-2.1Co powder was consumed. The mixed powders were charged into a Union Process Attritor Mill (Model 01) with 200 $cm^3$ of milling media (0.25" diameter WC-Co balls). Milling was done under hexane (160 ml). The agitator was rotated to 250 rpm. The milling time was 2 hours 50 minutes. The final powder composition was WC-8Co-0.8$Cr_3C_2$-0.4VC. Approximately 31.8 gms of powder was recovered from the mill.

EXAMPLE G

Sintering of WC-8Co-0.8$Cr_3C_2$-0.4VC Powder from WC-2.1Co+Co-Cr-C Master Alloy Powder+ Co-V-C Master Alloy Powder 3.0248 g of powder, prepared in Example F, was die compacted into a 2.54 mm high disk of 15.18 mm diameter using a pressure of 256 MPa. After heating at 900° C. in a flowing mixture of 1% ethylene/hydrogen for 1 hour, the disk was pressureless sintered in a vacuum induction furnace according to the temperature schedule shown in FIG. 1. After sintering the disk was 1.76 mm high with a diameter of 11.8 mm. The final measured density was 14.47 g/$cm^3$. The measured hardness of the material was Hv30=1875. The measured magnetic coercivity was Hc=560 Oe.

EXAMPLE H

Preparation of WC-9.4Co-0.8$Cr_3C_2$-0.4VC Powder from WC-3.7Co+Co-Cr-C Master Alloy Powder+ Co-V-C Master Alloy Powder 1.2447 gm of Co-Cr-C master alloy powder, prepared as in Example A, 0.7731 gm of Co-V-C master alloy powder, prepared as in Example D, and 26.0006 gm of WC-3.7Co powder were mixed by shaking in a capped test tube. The master alloy powders were added along with the WC-3.7Co powder, in small amounts, until the master alloy powders were consumed. Increasing amounts of WC-3.7Co powder were added to the mixed powders until all of the WC-3.7Co powder was consumed. The mixed powders were charged into a Union Process Attritor Mill (Model 01) with 200 $cm^3$ of milling media (0.25" diameter WC-Co balls). Milling was done under hexane (160 ml). The agitator was rotated at 250 rpm. The milling time was 2 hours 50 minutes. The final powder composition was WC-9.4Co-0.8$Cr_3C_2$-0.4VC. Approximately 31.8 gms of powder was recovered from the mill.

EXAMPLE I

Figure 2:
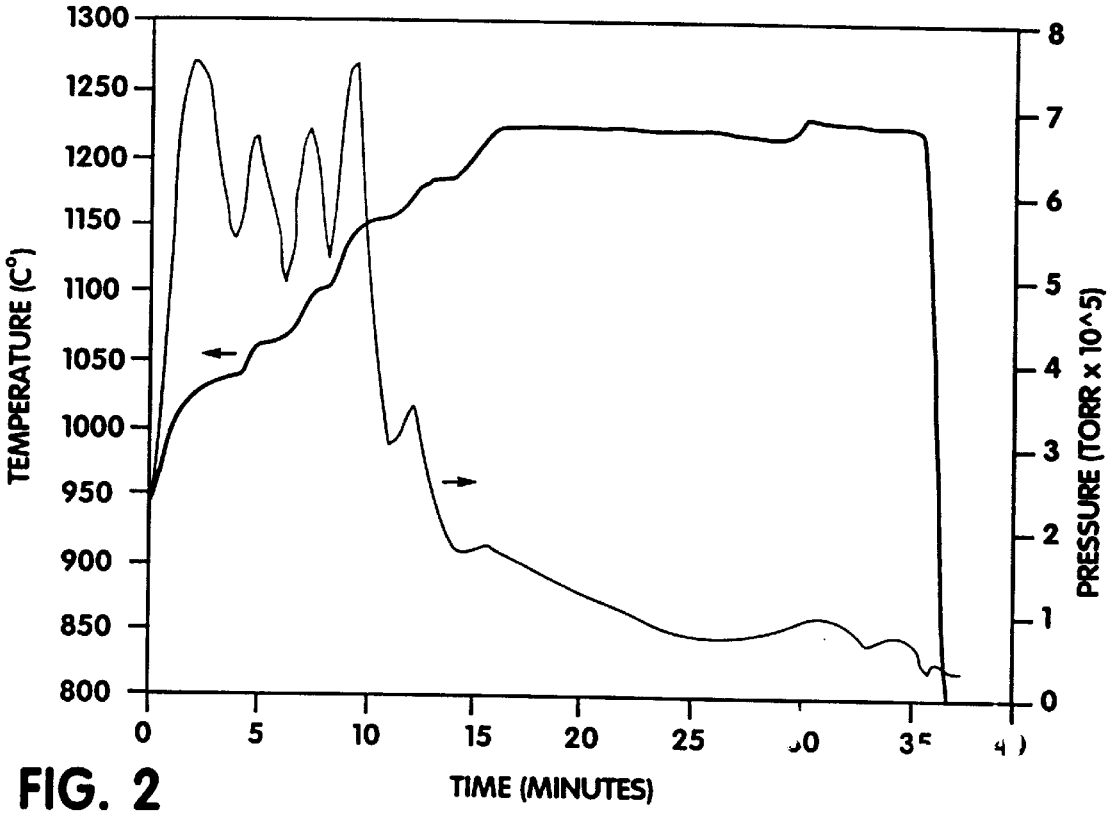
FIG. 2 is a graphic depiction of the sintering temperature used in Example I.

Sintering of WC-9.4Co-0.8$Cr_3C_2$-0.4VC Powder from WC-3.7Co+Co-Cr-C Master Alloy Powder+ Co-V-C Master Alloy Powder 4.57 g of powder, prepared in Example H, was die compacted into a 3.15 mm high disk of 15.2 mm diameter using a pressure of 256 MPa. After heating at 900° C. in a flowing mixture of 1% ethylene/hydrogen for 1 hour, the disk was pressureless sintered in a vacuum induction furnace according to the temperature schedule shown in FIG. 2. After sintering the disk was 2.45 mm high with a diameter of 11.87 mm. The final measured density was 14.3 g/$cm^3$. The measured hardness of the material was Hv30=2026. The measured magnetic coercivity was Hc=593 Oe.

EXAMPLE J

Preparation of WC-11.6Co-1.3$Cr_3C_2$-0.4VC Powder from WC-3.7Co+Co-Cr-C Master Alloy Powder+ Co-V-C Master Alloy Powder 2.4075 gm of Co-Cr-C master alloy powder, prepared as in Example A, 0.9204 gm of Co-V-C master alloy powder, prepared as in Example D, and 30.0008 gm of WC-3.7Co powder were mixed by shaking in a capped test tube. The master alloy powders were added along with the WC-3.7Co powder, in small amounts, until the master alloy powders were consumed. Increasing amounts of WC-3.7Co powder were added to the mixed powders until all of the WC-3.7Co powder was consumed. The mixed powders were charged into a Union Process Attritor Mill (Model 01) with 200 $cm^3$ of milling media (0.25" diameter WC-Co balls). Milling was done under hexane (160 ml). The agitator was rotated at 250 rpm. The milling time was 2 hours 50 minutes. The final powder composition was WC-11.6Co-1.3$Cr_3C_2$-0.4VC. Approximately 31 gms of powder was recovered from the mill.

EXAMPLE K

Figure 3:
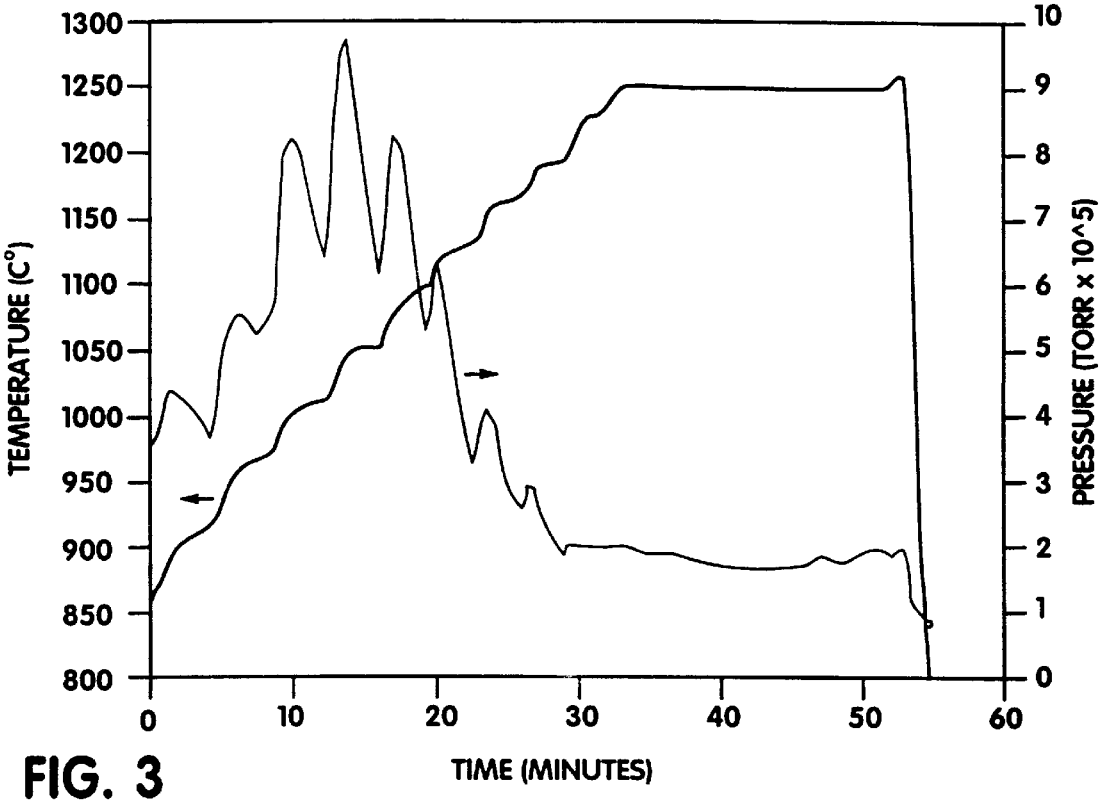
FIG. 3 is a graphic depiction of the sintering temperature used in Example K.

Sintering of WC-11.6Co-1.3$CrC_2$-0.4VC Powder from WC-3.7Co+Co-Cr-C Master Alloy Powder+ Co-V-C Master Alloy Powder 3.98 g of powder, prepared in Example J, was die compacted into a 3.22 mm high disk of 15.11 mm diameter using a pressure of 256 MPa. After heating at 900° C. in a flowing mixture of 1% ethylene/hydrogen for 1 hour, the disk was pressureless sintered in a vacuum induction furnace according to the temperature schedule shown in FIG. 3. After sintering the disk was 2.57 mm high was a diameter of 11.94 mm. The final measured density was 13.98 g/$cm^3$. The measured hardness of the material was Hv30=1809. The measured magnetic coercivity was Hc=488 Oe.

EXAMPLE L

Preparation of WC-9.4Co-0.8$CrC_2$-0.4VC Powder from Co-$Cr_3C_2$ and Co-VC Mechanically Mixed Master Alloy Powders 1.4381 gm of Co-$Cr_3C_2$ master alloy powder and 0.8928 gm of Co-VC master alloy powder, prepared as in Example E, and 30.0021 gm of WC-3.7Co powder were mixed by shaking in a capped test tube. The master alloy powders were added along with the WC-3.7Co powder, in small amounts, until the master alloy powders were consumed. Increasing amounts of WC-3.7Co powder were added to the mixed powders until all of the WC-3.7Co powder was consumed. The mixed powders were charged into a Union Process Attritor Mill (Model 01) with 200 $cm^3$ of milling media (0.25" diameter WC-Co balls). Milling was done under hexane (160 ml). The agitator was rotated at 250 rpm. The milling time was 2 hours 50 minutes. The final powder composition was WC-9.4Co-0.8$Cr_3C_2$-0.4VC. Approximately 30 gms of powder was recovered from the mill.

EXAMPLE M

Figure 4:
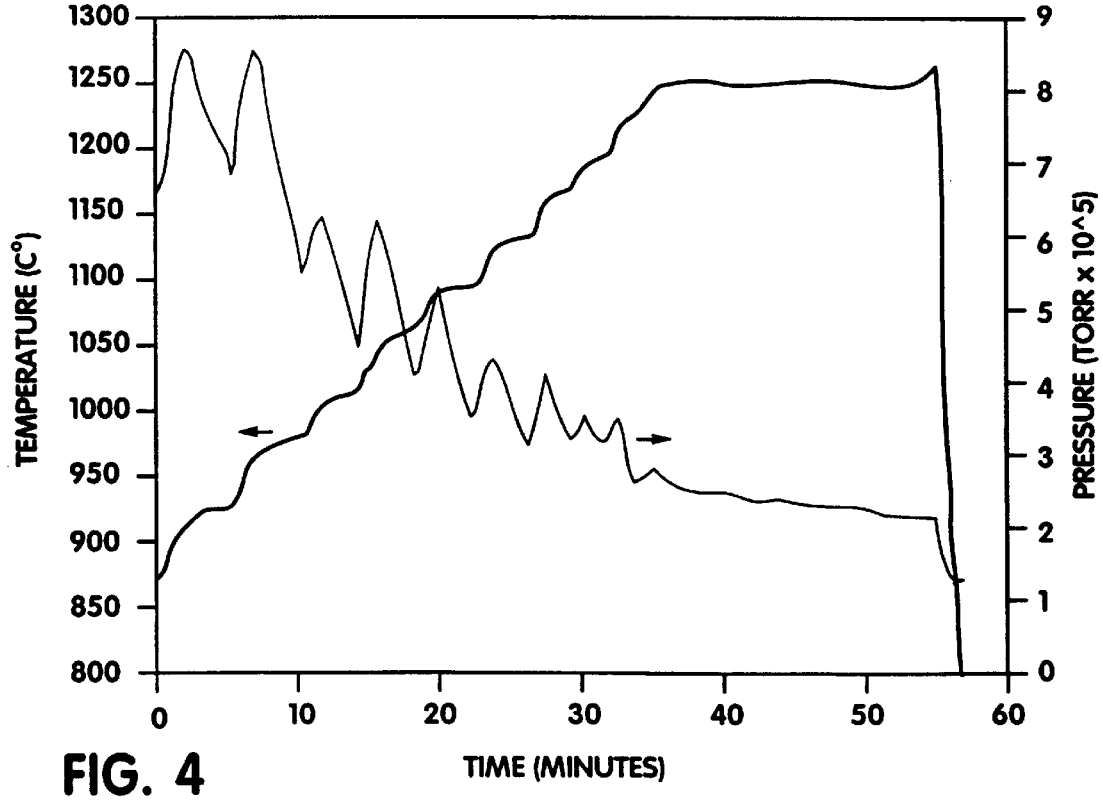
FIG. 4 is a graphic depiction of the sintering temperature used in Example M.

Sintering of WC-9.4Co-0.8$CrC_2$-0.4VC Powder from Co-$Cr_3C_2$ and Co-VC Mechanically Mixed Master Alloy Powders 4.04 g of powder, prepared in Example L, was die compacted into a 3.15 mm high disk of 15.07 mm diameter using a pressure of 256 MPa. After heating at 900° C. in a flowing mixture of 1% ethylene/hydrogen for 1 hour, the disk was pressureless sintered in a vacuum induction furnace according to the temperature schedule shown in FIG. 4. After sintering the disk was 2.58 mm high with a diameter of 11.92 mm. The final measured density was 14.26 g/$cm^3$. The measured hardness of the material was Hv30=2040. The measured magnetic coercivity was Hc=571 Oe.

What is claimed is:

1. A low melting point alloy comprising at least one binding metal selected from the group consisting of iron, cobalt and nickel and at least one of a grain growth inhibiting metal selected from the group consisting of vanadium, chromium, tantalum and niobium in an amount effective to provide an alloy having a liquid formation temperature of less than about 1300° C. and carbon in an amount effective to form carbides of said grain growth inhibiting metal wherein said alloy has no more than 60% iron.

2. The alloy claimed in claim 1 having at least 3% of said grain growth inhibiting metal.

3. The alloy claimed in claim 2 having at least 5 to 25% of said grain growth inhibiting metal.

4. The alloy claimed in claim 3 having 3% to 20% vanadium.

5. The low melting point alloy claimed in claim 1 having a liquid formation temperature of less than about 1250° C.

6. An article, comprising particles of a ceramic powder that have been sintered with a sintering aid comprising a low melting alloy comprising at least one binding metal selected from the group consisting of iron, cobalt and nickel and at least 3% of a grain growth inhibiting metal selected from the group vanadium, chromium, tantalum and niobium in an amount effective to provide an alloy having a liquid formation temperature of less than about 1300° C. and carbon in an amount effective to form carbides of said grain growth inhibiting metal, wherein said alloy has no more than 60% iron.

7. The article claimed in claim 6 wherein said article is sintered to greater than 95% of full amount.

8. The article claimed in claim 7 wherein said ceramic powder is a carbide selected from the group consisting of tungsten carbide, molybdenum carbide, chromium carbide, tantalum carbide, niobium carbide, vanadium carbide and titanium carbide, and mixtures thereof.

9. The article claimed in claim 6 wherein said low melting alloy has a liquid formation temperature of less than 1250° C.

10. The article claimed in claim 7 wherein said ceramic powder comprises tungsten carbide and wherein said binding metal comprises cobalt.

11. The article claimed in claim 10 having a chemical composition of WC-3 to 30 Co, 0 to 10 Cr, 0 to 10 V and carbon.

12. An article comprising particles of a cermet powder that have been sintered by use of a sintering aid comprising a low melting alloy comprising at least one binding metal selected from the group consisting of iron, cobalt and nickel and at least one grain growth inhibiting metal selected from the group consisting of vanadium, chromium, tantalum and niobium in an amount effective to provide an alloy having a liquid forming temperature of less than about 1300° C. and carbon in an amount effective to form carbides of said grain growth inhibiting metal, wherein said alloy has not more than 60% iron.

13. The article claimed in claim 11 sintered to greater than 95% of full density.

14. The article claimed in claim 13 wherein said cermet powder comprises at least one carbide selected form the group consisting of tungsten carbide, molybdenum carbide, chromium carbide, tantalum carbide, niobium carbide, vanadium carbide and titanium carbide and at least one metal selected from the group consisting of iron, cobalt and nickel.

15. The article claimed in claim 13 wherein said low melting alloy has a liquid formation temperature of less than 1250° C.

16. The article claimed in claim 14 wherein said carbide comprises tungsten carbide and wherein said metal comprises cobalt.

17. The articled claimed in claim 15 having a chemical composition of WC-3 to 30 Co, 0 to 10 Cr, 0 to 10 V and carbon.

18. The article claimed in claim 17 having 0 to 1.5% V.

19. The article claimed in claim 17 having 0 to 0.5% V.

20. An article, comprising particles of a ceramic powder and particles of a cermet powder that have been sintered by use of a sintering aid comprising a low melting alloy comprising at least one binding metal selected from the group consisting of iron, cobalt and nickel and at least one grain growth inhibiting metal selected from the group vanadium, chromium, tantalum and niobium in an amount effect to provide an alloy having a liquid formation temperature of less than about 1300° C. and carbon in an amount effective to form carbides of said grain growth inhibiting metal, wherein said alloy has no more than 60% iron.

21. The article claimed in claim 19 sintered to greater than 95% of full density.

22. The article claimed in claim 20 wherein said ceramic powder is a carbide selected from the group consisting of tungsten carbide, molybdenum carbide, chromium carbide, tantalum carbide, niobium carbide, vanadium carbide and titanium carbide, and mixtures thereof, and wherein said cermet powder comprises at least one carbide selected from the group consisting of tungsten carbide, molybdenum carbide chromium carbide, tantalum carbide, niobium carbide, vanadium carbide and titanium carbide, and at least one metal selected from the group consisting of iron, cobalt and nickel.

23. The article claimed in claim 20 wherein said low melting alloy has a liquid formation temperature of less than 1250° C.

24. The article claimed in claim 22 wherein said ceramic powder comprises tungsten carbide and wherein said cermet powder comprises tungsten carbide plus cobalt.

25. The article claimed in claim 6 wherein said ceramic powder has a mean ceramic grain size of 0.5 $\mu$m or less.

26. The article claimed in claim 12 wherein said cement powder has a mean ceramic grain size of 0.5 $\mu$m or less.

27. The article claimed in claim 19, sintered to greater than 98% of full density, wherein said ceramic powder has a mean grain size greater than 1 $\mu$m and said cermet powder has a ceramic phase mean grain size less than 1 $\mu$m.

* * * * *